United States Patent [19]

Bakker

[11] Patent Number: 4,489,466

[45] Date of Patent: Dec. 25, 1984

[54] SUSPENDER FASTENER

[75] Inventor: John A. Bakker, Bartlett, Ill.

[73] Assignee: Illinois Tool Works Inc., Chicago, Ill.

[21] Appl. No.: 473,485

[22] Filed: Mar. 9, 1983

[51] Int. Cl.[3] ..... A44B 21/00

[52] U.S. Cl. ..... 24/489; 24/494; 24/504; 24/516; 24/521

[58] Field of Search ..... 24/494, 495, 504, 505, 24/489, 498, 493, 516, 517, 521, 538, 539, 540, 541

[56] References Cited

U.S. PATENT DOCUMENTS

| | | | |
|---|---|---|---|
| 717,367 | 12/1902 | Ellis | 24/517 |
| 878,049 | 2/1908 | Dikeman | 24/521 |
| 1,332,566 | 3/1920 | Northup | 24/517 |
| 2,214,524 | 9/1940 | Deming | 24/516 |
| 3,881,228 | 5/1975 | Takabayashi et al. | 24/504 |
| 3,914,828 | 10/1975 | Noda | 24/504 |
| 4,005,510 | 2/1977 | Noda | 24/504 |
| 4,084,299 | 4/1978 | Noda | 24/504 |
| 4,086,686 | 5/1978 | Takabayashi | 24/504 |

FOREIGN PATENT DOCUMENTS

| | | | |
|---|---|---|---|
| 1261455 | 2/1968 | Fed. Rep. of Germany | 24/494 |
| 1419205 | 12/1975 | United Kingdom | 24/516 |

*Primary Examiner*—Victor N. Sakran

*Attorney, Agent, or Firm*—Thomas W. Buckman; John P. O'Brien

[57] ABSTRACT

A novel suspender fastener is disclosed. The suspender fastener comprises a first lever, a second lever, and a ratchet. The first and second levers are pivotally connected in a manner such that a fulcrum is formed therebetween. A first pair of mutually proximate end portions of the levers are longitudinally spaced from the fulcrum, and form a pair of jaws for engaging a garment therebetween. The ratchet preferably includes a loop for securing a suspender thereto. The ratchet is variably engageable with the first and second levers in a manner such that co-action between the ratchet and the levers causes the jaws to progressively tighten.

4 Claims, 18 Drawing Figures

SUSPENDER FASTENER

This invention is directed to a novel suspender fastener.

BACKGROUND OF THE INVENTION

Most suspender fasteners comprise a pair of jaws and at least one lever. The lever is for bringing the jaws together or for spreading the jaws apart. The jaws are for securing a garment therebetween.

The distance between the jaws of most suspender fasteners is a dimension which generally cannot be progressively varied. For example, suspender fasteners generally present a first dimension between the jaws for inserting the garment therebetween, and a second dimension, relatively less than the first, for securing the garment therebetween. Occasionally the second dimension is inadequate for securing the suspender fastener to the garment, and if the jaws are deformable (which is the case in most metal suspender fasteners), the jaws can be deformed so as to reduce the second dimension so that the suspender fastener cannot function as intended.

Suspender fasteners are often made of a corrodible metal. Metal suspender fasteners often incorporate several small parts which can render the suspender fastener difficult to operate.

Attempts to deform a jaw to alter the above-discussed dimensions occasionally causes damage to the suspender fastener or otherwise render such a fastener unable to function as intended. More often, however, such a reduction of the second-mentioned dimension also reduces the first-mentioned dimension, whereupon the jaws, after being thus deformed, do not open wide enough for inserting the garment therebetween.

OBJECTS AND SUMMARY OF THE INVENTION

Accordingly, it is a general object of this invention to provide a novel suspender fastener.

A more specific object is to provide a suspender fastener variably engageable with a garment.

A further object is to provide such a suspender fastener which is easy to operate and which does not corrode.

Briefly, and in accordance with the foregoing objects, a suspender fastener according to the invention comprises a first lever, a second lever, and a ratchet. The first and second levers are pivotally connected in a manner such that a fulcrum is formed therebetween. A first pair of mutually proximate end portions of the levers are longitudinally spaced from the fulcrum, and form a pair of jaws for engaging a garment therebetween. The ratchet preferably includes a loop for securing a suspender thereto. The ratchet is variably engageable with the first and second levers in a manner such that co-action between tthe ratchet and the levers causes the jaws to progressively tighten.

BRIEF DESCRIPTION OF THE DRAWINGS

The foregoing, as well as other objects, features or advantages of the present invention will become more readily understood upon reading the following detailed description of the illustrated embodiment, together with reference to the drawings, wherein.

DETAILED DESCRIPTION OF THE ILLUSTRATED EMBODIMENT

Figure 1:
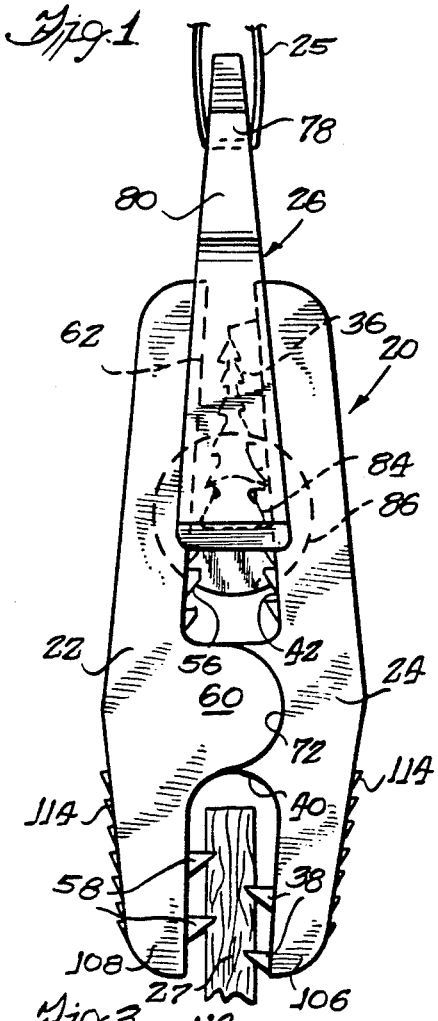
FIG. 1 is an end view of the novel suspender fastener, secured by a suspender strap, and engaging an edge of garment.

Referring generally to the drawings and initially to FIG. 1, a novel suspender fastener 20 will now be discussed. The suspender fastener 20 comprises a first lever 22 (FIGS. 2, 8 and 9) pivotally connected to a second lever 24 (FIGS. 2 and 10), and a ratchet 26 (FIGS. 2 and 14) engaged between the levers 22, 24. The first and second levers 22, 24 are preferably slightly elongated. The suspender fastener 20 is preferably made of a resilient, plastic material, such as, for example, commercially-available acetal resin.

At one end of the suspender fastener 20, a suspender strap 25 (FIG. 1) is preferably looped through the ratchet 26, and at the opposite end of the suspender fastener 20 a piece of garment 27 is engaged by the fastener 20 in a manner which will be described more fully below.

Figure 9:
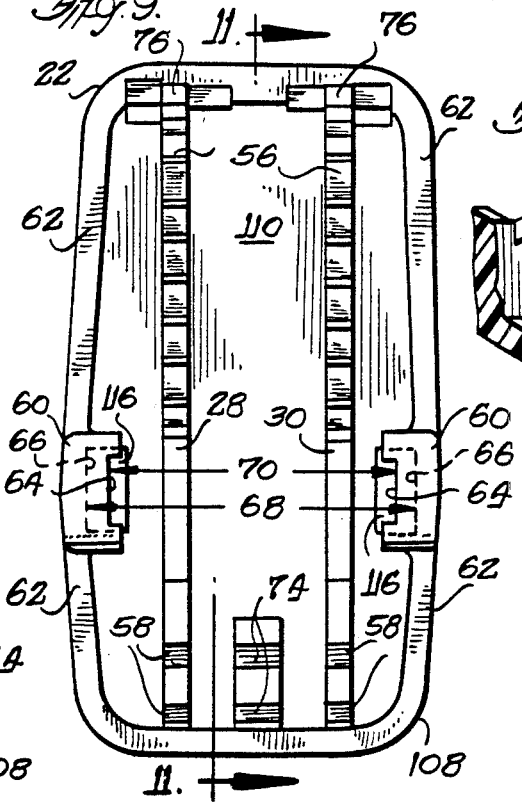
FIG. 9 is a plan view of the inside surface of the lever presented in FIG. 8.

Internally, the levers 22, 24 are designed to interfit and are dissimilar to each other. Referring to FIG. 9, it will be seen, for example, that the first lever 22 includes first and second longitudinally disposed integral ribs 28, 30. The second lever 24 (FIG. 10) also includes first and second longitudinally disposed integral ribs 32, 34. When the first and second levers 22, 24 are assembled, the first and second ribs 28, 30 of the first lever 22 are disposed between the first and second ribs 32, 34 of the second lever 24.

Figure 12:
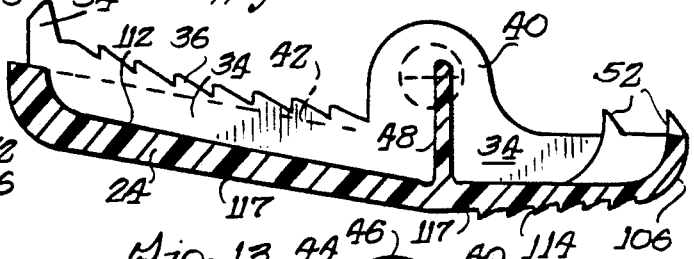
FIG. 12 is a sectional view taken along the line 12—12 in FIG. 10.

The first and second ribs 32, 34 of the second lever 24 (FIG. 10) are very similar to each other and only the second rib 34 will now be discussed. Referring to FIG. 12 it will be seen that one end portion of the rib 34 includes a plurality of (preferably 7) integral serrations 36, each of which is preferably longitudinally disposed outwardly and has a flattened upper tip. The other end portion of the rib 34 includes a plurality of (preferably 2) integral teeth 38, each of which is preferably longitudinally disposed inwardly. The first rib 32 provides the second lever 24 with a first plurality of teeth 38 and the second rib 34 provides a second plurality of teeth 38.

Figure 10:
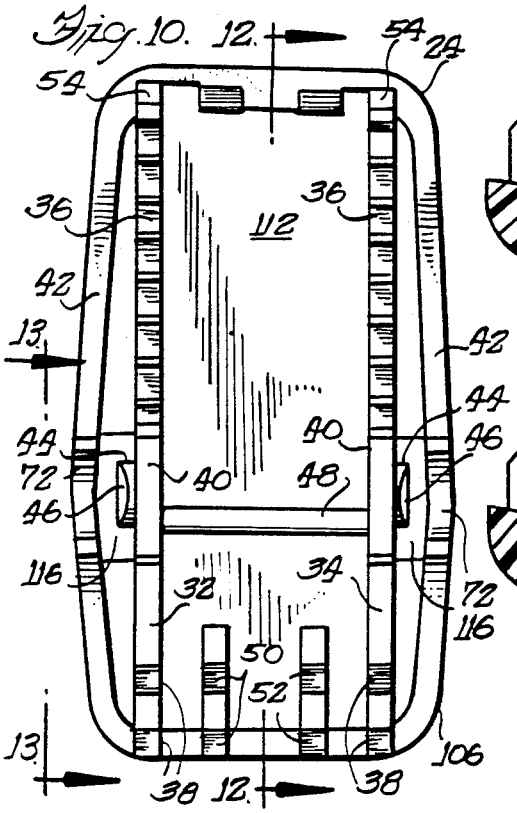
FIG. 10 is plan view of the inside surface of the other lever.
Figure 13:
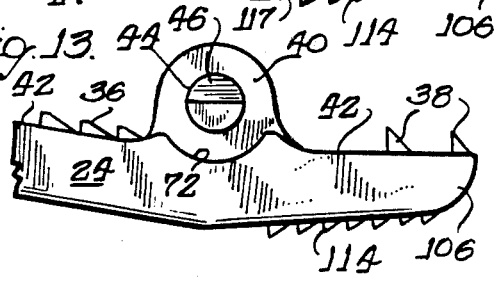
FIG. 13 is a fragmentary side view taken along the line 13—13 in FIG. 10.

Referring to the second rib 34, it will be seen that intermediate the serrations 36 and the teeth 38 is an integral pivot 40, disposed upwardly in relation to an inner edge surface 42 of the second lever 24 (FIG. 13). The pivot 40 (FIGS. 10, 13) includes a transverse or lateral pin 44, integral with the pivot 40, and disposed outwardly therefrom (FIG. 10). An upper or inwardy-disposed portion 46 of the pin 44 is recessed (FIGS. 10, 13) so that the first and second levers 22, 24 are snap engageable together (in a manner which will be described in greater detail below). The second lever 24 also includes a transverse or lateral rib 48 disposed intermediate the pivots 40 (FIGS. 10, 12). Opposite end portions of the rib 48 are respectively integral with each respective one of the two pivots 40 (FIG. 10).

The second lever 24 further preferably includes a third plurality (preferably 2) and a fourth plurality of (preferably 2) integral teeth 50, 52 longitudinally arranged intermediate the first and second ribs 32, 34 in relatively-proximate relation to the teeth 38 (FIG. 10). Similar to the teeth 38, each one of the teeth 50, 52 is preferably longitudinally disposed inwardly. The teeth 38, 50 and 52 are preferably aligned, and when viewed on edge from the side (FIG. 13) of the lever 24, the teeth 38, 50 and 52 individually present substantially the same profile.

Referring to FIGS. 1, 3–5, 7 and 12, it will be seen that a surface projected by the upper tips of the serrations 36 rises progressively above the inner edge surface 42 of the second lever 24 as the distance between the serrations 36 and the pivot 40 increases. The first and second ribs 32, 34 of the second lever 24 also individually include an integral retainer 54 (FIGS. 10, 12) for retaining the ratchet 26 between the first and second levers 22, 24. Each such retainer 54 is longitudinally spaced relatively farther from its respective pivot 40 than are the serrations 36.

Referring back to FIG. 9, it will be seen that the first lever 22 includes many of the above-discussed features of the second lever 24, but that such features are included in the first lever 22 in a manner such that the first and second levers 22, 24 are complimentary. Since the first and second ribs 28, 30 of the first lever 22 include essentially indentical features, only the second rib 30 will now be discussed.

Figure 9A:
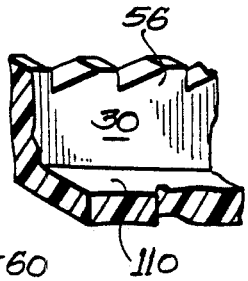
FIG. 9A is a fragmentary view, in section, of a portion of the inside surface presented in FIG. 9.
Figure 11:
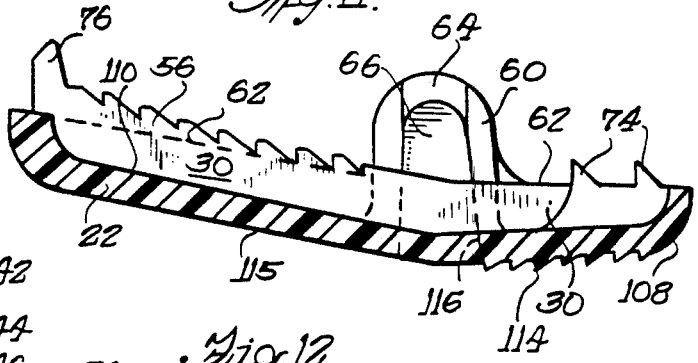
FIG. 11 is a sectional view taken along the line 11—11 in FIG. 9.

One end portion of the rib 30 includes a plurality of (preferably 7) integral serrations 56, each one of which is preferably longitudinally disposed outwardly and has a flattened upper tip (FIGS. 9, 9A and 11). The other end portion of the rib 30 includes a plurality of (preferably 2) integral teeth 58, each one of which is preferably longitudinally disposed inwardly. The first rib 28 provides the first lever 22 with a first plurality of teeth 58, and the second rib 30 provides a second plurality of teeth 58.

Intermediate the serrations 56 and the teeth 58 is an arcuate pivot retainer 60 (FIGS. 9, 11), disposed upwardly in relation to an inner edge surface 62 (of the first lever 22) with which it is integral. The two pivot retainers 60 each include a vertical slot 64 disposed transverse to the first and second ribs 28, 30 for receiving the respective upper portion 46 of a respective pin 44. Each pivot retainer 60 further includes an indent 66 also disposed transverse to the first and second ribs 28, 30. A first transverse dimension 68 intermediate the indents 66 is greater than a second transverse dimension 70 intermediate the slots 64 (FIG. 9).

The pivot retainers 60 are resilient; and upon engagement of the slots 64 of the first lever 22 with the respective pins 44 of the second lever 24 such that the first and second levers 22, 24 are urged together, the pivot retainers 60 will be seen to flex laterally outwardly until the pins 44 snap engage into the respective indents 66.

The inner edge portion 42 of the second lever 24 further includes an arcuate depression 72 (FIGS. 2, 10, 13) laterally disposed from each respective pivot 40. The depression 72 has a curvature which is complimentary to the curvature of the pivot retainer 60, with which it is tangent (FIGS. 1, 3–5 and 7), for receiving the pivot retainer 60, and for permitting pivoting, along the tangent surfaces, of one of the first and second levers 22, 24 relative to the other.

The first lever 22 further preferably includes a third plurality of (preferably 2) integral teeth 74 (FIGS. 9, 11) longitudinally arranged intermediate the teeth 58. Similar to the teeth 58, each one of the teeth 74 is preferably longitudinally disposed inwardly. The teeth 58, 74 are preferably aligned and when viewed on edge from the side the lever 22, the teeth 58, 74 individually present substantially the same profile.

Also, similar to the serrations 36 of the second lever 24, it will be seen, by referring to FIGS. 1, 3–5, 7 and 11, that a surface projected by the upper tips of the serrations 56 progressively rises above the inner edge surface 62 of the first lever 22 as the distance between the serrations 56 and the pivot retainer 60 increases. The first and second ribs 28, 30 of the first lever 22 similarly individually include an integral retainer 76 (FIGS. 9, 11) for retaining the ratchet 26 between the first and second levers 22, 24. Each such retainer 76 is longitudinally spaced relatively farther from its respective pivot retainer 60 than are the serrations 56.

Figure 3:
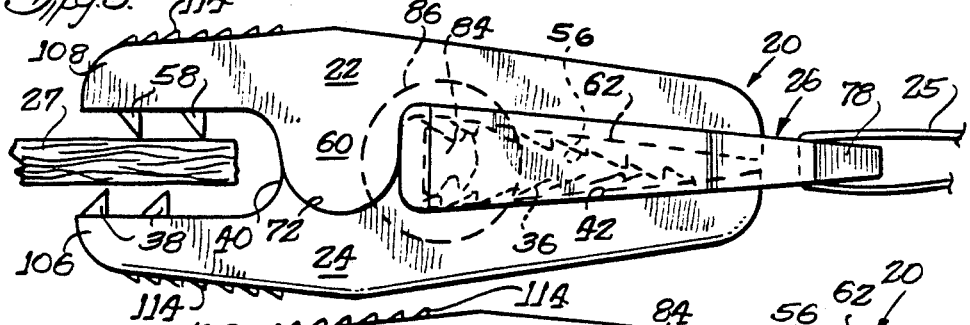
FIG. 3 is a side view (which includes phantom lines) showing the jaws of the suspender fastener in a relatively open position.
Figure 4:
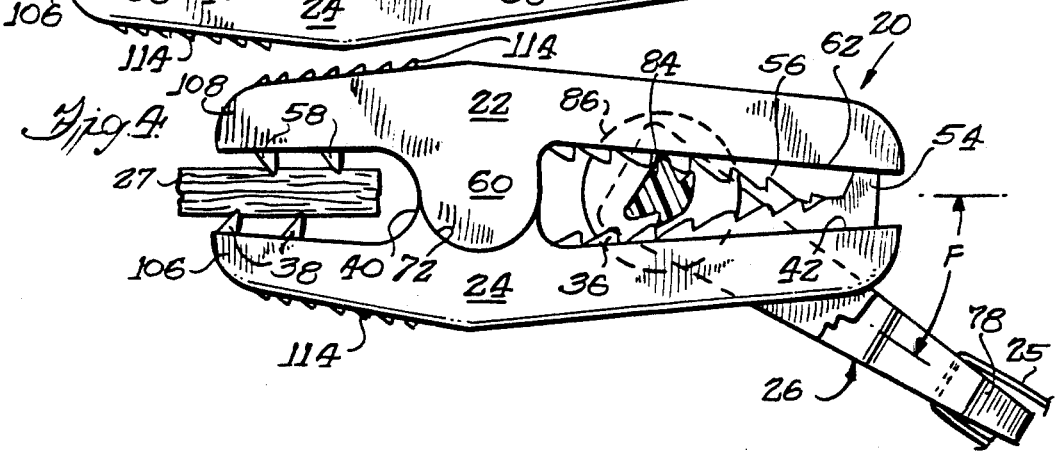
FIG. 4 is a partially fragmented side view (which includes phantom lines) illustrating movement of the ratchet relative to the levers (of the suspender fastener) and the resultant drawing together of the jaws.
Figure 5:
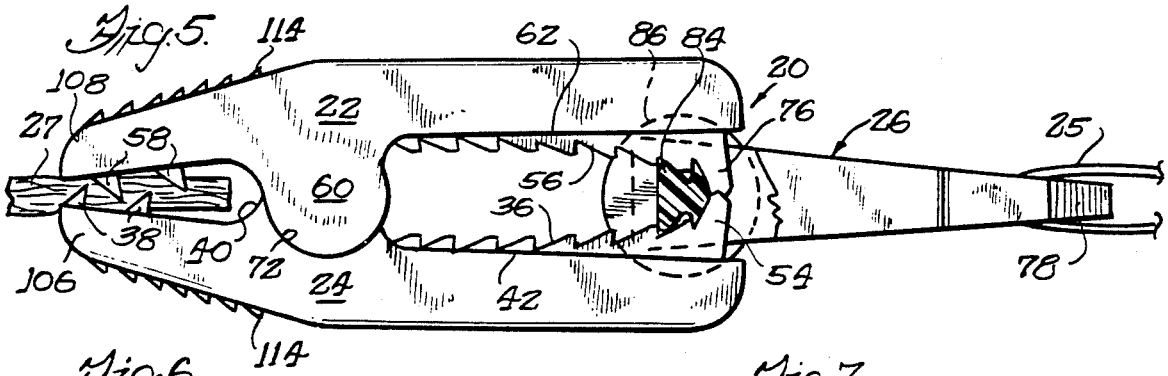
FIG. 5 is a partially fragmented side view (which includes phantom lines) showing the jaws fully closed.
Figure 6:
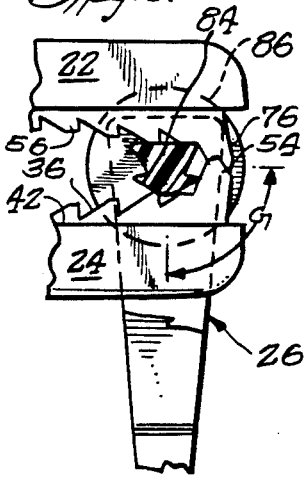
FIG. 6 is a partially fragmented side view (which includes phantom lines) illustrating movement of the ratchet relative to the levers for opening the jaws.

When the first and second levers 22, 24 are snap engaged as above described, the teeth 74 interfit between the teeth 50 and the teeth 52. Referring to FIGS. 3–5, moreover, it will be seen that the teeth 38 preferably interfit in the longitudinal direction intermediate the teeth 58 for securing the garment 27 therebetween. The teeth 38, 50 and 52 (FIG. 10) and the teeth 58, 74 (FIG. 9) are presented as being relatively sharp. For some garments sharp teeth is undesirable. It can therefore be appreciated that the teeth of the present invention can be rounded or can be formed to have relatively flat tops, if it is desirable to do so.

The ratchet 26 interfits intermediate the first and second levers 22, 24 and co-acts with the serrations 36, 56 in a manner (described in greater detail below) so as to provide a variably increasing clamping pressure intermediate the teeth 38, 50 and 52 (FIG. 10) and the teeth 58 and 74 (FIG. 9).

Figure 2:
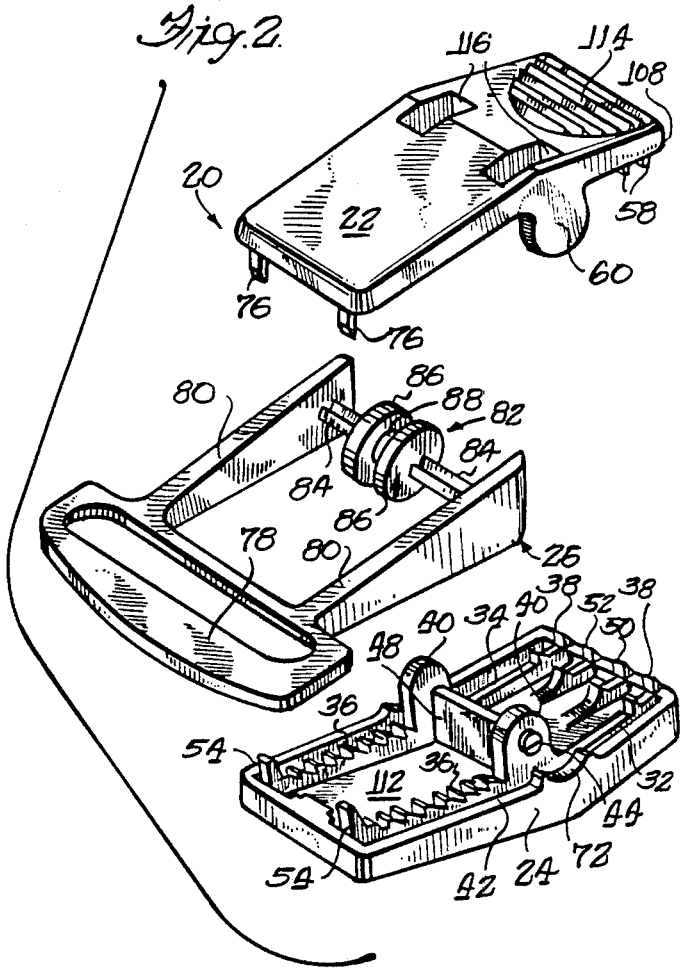
FIG. 2 is an exploded view, in isometric, of the suspender fastener.
Figure 14:
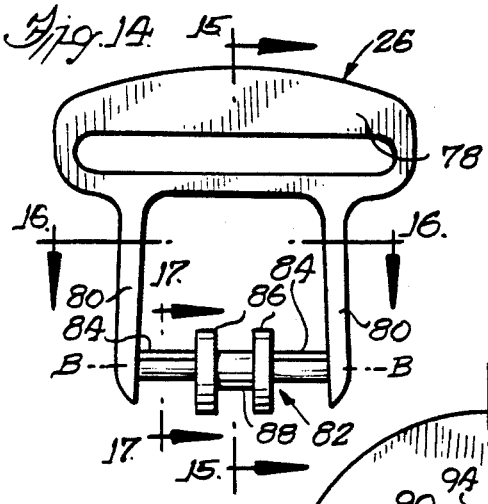
FIG. 14 is a plan view of the ratchet.

Referring to FIG. 14, it will be seen that the ratchet 26 includes a transverse suspender loop 78 through which the suspender strap 25 is insertable (FIG. 1).

Figure 16:
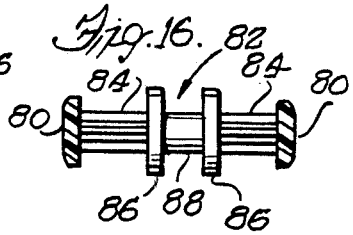
FIG. 16 is a sectional view taken along the lines 16—16 in FIG. 14.

Extending outwardly in a common plane from a side portion of the loop 78 is a pair of arms 80. Arranged transversely to the arms 80 in distal relation to the loop 78 is an elongated, one-piece bar member 82 (FIGS. 2, 14 and 16) which is integral at opposite ends thereof with respective end portions of the arms 80.

Figure 15:
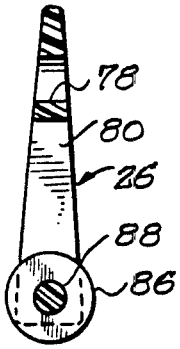
FIG. 15 is a sectional view taken along the line 15—15 in FIG. 14.

The bar member 82 (please refer to FIG. 14) comprises two catches 84, two rollers 86, and a spacer 88. The spacer 88 is intermediate the rollers 86, and the rollers 86 are intermediate the catches 84. Referring to FIG. 15, it will be seen that the rollers 86 and the spacer 88 are preferably circular in cross section, and that the rollers 86 have a diameter which is greater than the diameter of the spacer 88. The centers of the rollers 86 and the spacer 88 are co-linear with an axis B—B (FIG. 14) of the bar member 82.

Figure 17:
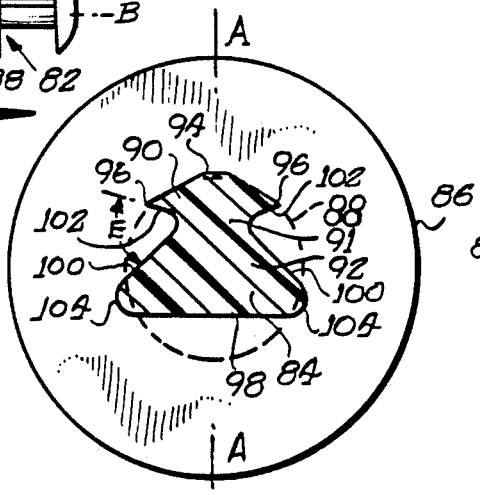
FIG. 17 is a sectional view, on an enlarged scale, taken along the line 17—17 in FIG. 14.

It will be seen, by referring to FIG. 17, that the catch 84 has an irregular cross section which will now be described. The cross section of the catch 84, symmetric about an axis A—A, comprises a head 90 integral through a neck 91 to a body 92. The head 90 has a flat top 94 and pointed ears 96 disposed transverse to the axis A—A. The flat top 94 and end portions of the ears 96 are radially spaced from the axis B—B slightly more than is the circumference of the spacer 88. From the neck 91, the body 92 uniformly extends in the transverse direction outwardly from the axis A—A and then curves inwardly and forms a flat base 98. The spacer 88 extends farther outwardly radially from the axis B—B than most of the base 98. A side wall portion 100 of the base 98 is planar as is a lower edge 102 of the ear 96. An acute angle, E (FIG. 17), between the side wall portion 100 and the lower edge 102 is preferably about 27 degrees. Intermediate the base 98 and the side wall portion 100 is a curved toe 104 which extends farther outwardly radially from the axis B—B than the flat top 94 and/or the ears 96. The rollers 96 extend substantially farther outwardly radially from the axis B—B than the toes 104.

The rollers 86 interfit intermediate the first and second ribs 28, 30 of the first lever 22. The catches 84 engage the serrations 36 and 56 (FIGS. 1 and 3–6).

With the bar member 82 disposed transversely intermediate (FIG. 2) the pivotally connected first and second levers 22, 24 (FIG. 1), with the bar member 82 relatively proximate to the pivot 40, and with the loop 78 disposed longitudinally opposite the teeth 38, 58 (FIG. 3), the teeth 38, 58 can be fully spread apart. The teeth 38 are part of a lower jaw 106 of the fastener 20, and the teeth 58 are part of an upper jaw 108. When the garment 27 is inserted between the jaws 106, 108, outwardly-disposed longitudinal movement of the ratchet 26 relative to the levers 22, 24 will cause the catches 84 to engage and separate the serrations 36, 56 thereby tightening the jaws 106, 108 onto the garment 27 (FIGS. 3–5).

When the loop 78 of the ratchet 26 is rotated about the bar member 82 through an acute angle, F (FIG. 4), of preferably about 35 degrees relative to the longitudinal disposition of the ratchet 26 presented in FIG. 1, it will be seen that the catch 84 engaging the serrations 36, 56 acts as a ratchet to spread the first and second levers 22, 24 apart thereby closing the jaws 106, 108. Initially the toes 104 respectively engage oppositely disposed depressions of the serrations 36, 56. Ratcheting of the loop 78 as shown in FIG. 4, however, causes the lower ear 96 to engage with an adjacent lower depression of an adjacent lower serration 36, which, in turn, causes the upper toe 104 to advance longitudinally outwardly from the pivot 40 to an adjacent upper depression of an adjacent upper serration 56. This, in turn, causes the jaws 106, 108 to close progressively. Moving the loop 78 back to its original position (FIG. 1) causes the lower toe 104 to advance longitudinally outwardly from the pivot 40 to an adjacent lower depression of an adjacent lower serration 36. This similarly causes the jaws 106, 108 to close progressively. Such ratcheting is repeated either until the jaws 106, 108 are fully closed upon the garment 27 or until the bar member 82 engages the retainers 54, 76 (FIG. 5). When the bar member 82 engages the retainers 54, 76, the jaws are fully closed. It will be noted, by referring to FIG. 5, that the lateral distance between opposed serrations 36, 56 decreases as the longitudinal distance between the pivots 40 and such opposed serrations 36, 56 increases.

During such ratcheting, the rollers 86 are very close to but engage neither an inner surface 110 (FIG. 9) of the first lever 22 nor an inner surface 112 (FIG. 10) of the second lever 24.

Figure 7:
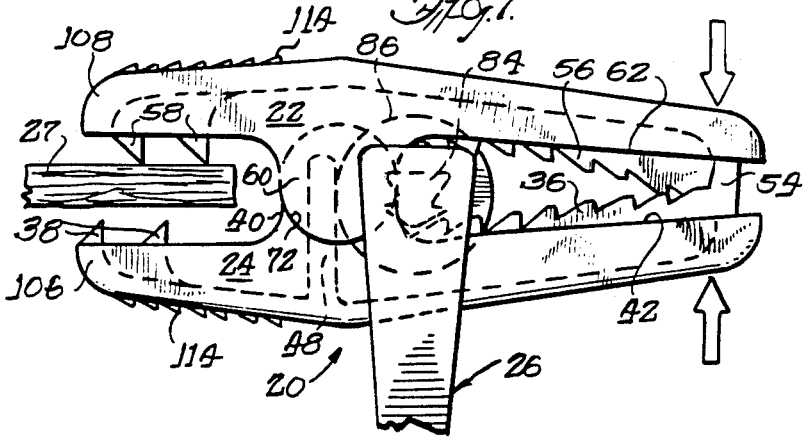
FIG. 7 is a side view (which includes phantom lines) showing the manner of sliding the ratchet relative to the levers for fully opening the jaws.

To release the jaws 106, 108 from a fully closed positon (FIG. 5), the loop 78 of the ratchet 26 is rotated about the bar member 82 through an angle, G (FIG. 6), preferably of about 90 degrees relative to the longitudinal disposition of the ratchet 26 presented in FIG. 5, the bar member 82 is urged toward the pivot 40, and mutually proximate end portions of the first and second levers 22, 24 (which include the retainers 54, 76) are urged together (FIG. 7).

The catches 84 thus co-operate to act as a wedge for variably urging the jaws 106, 108 together. It can be appreciated, by referring to FIGS. 1 and 3–7, that the jaws 106, 108 can thus be urged together (to different degrees) to engage with a variety of garments 27 of various thicknesses. Moreover, referring to FIGS. 14–17 and the above-described symmetrical nature of the catches 84, it can be appreciated that the loop 78 can equivalently be rotated upwardly, again by about an angle F, and then rotated downwardly to the horizontal position, to get the above-described ratcheting effect.

Figure 8:
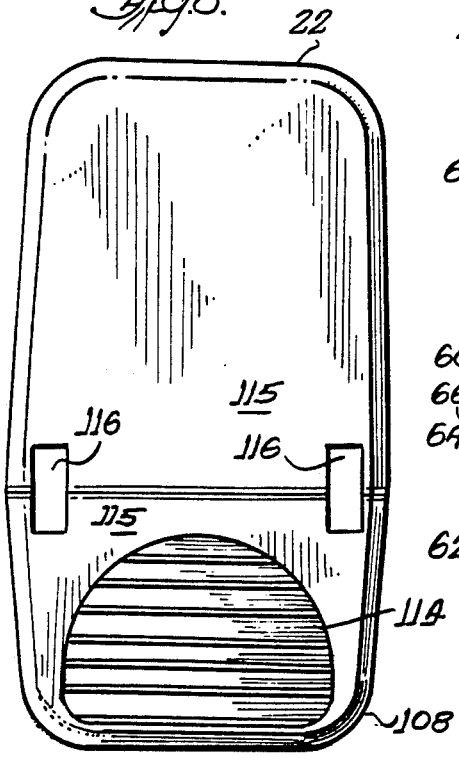
FIG. 8 is a plan view of an outside surface of one of the levers.

Externally, the first and second levers 22, 24 are very similar to each other, and although only the external surface of the first lever 22 is shown in FIG. 8, both levers 22, 24 will now be described. Referring to FIG. 8, it will be seen that the lever 22 (or 24) has rounded corners, and includes an integral, serrated, finger-gripping portion 114 at the end portion thereof which is proximate to the jaw 108 (or 106). When viewed from the side, it will be noted, by referring to FIGS. 11 and 12, that outside surfaces 115, 117 of the levers 22, 24 longitudinally converge inwardly from the pivot retainers 60 (or pivots 40).

The lever 22 (or 24) also includes a pair of elongated slits 116 which are disposed longitudinally through opposite end portions of the surface 115 (or 117) of the lever 22 (or 24). On the first lever 22, each one of the slits 116 communicates with a respective one of the indents 66 (FIG. 11). The slits 116 of the second lever 24 are relatively slightly more elongated than are the slits 116 of the first lever 22. As to the slits 116 of either of the levers 22 or 24, such slits 116 provide sufficient openings for insertion therein of a suitable tool, such as a screwdriver (not shown), for prying the first and second levers 22, 24 apart for disassembling the suspender fastener 20.

Moreover, the suspender fastener 20 is preferably manufactured by a well-known injection-molding method, and is relatively less expensive to manufacture than is any one of a variety of commercially-available, metal suspender fasteners.

What has been illustrated and described herein is a novel suspender fastener. While the suspender fastener of the present invention has been illustrated and described with reference to a preferred embodiment, the invention is not limited thereto. On the contrary, alternatives, changes or modifications may become apparent to those skilled in the art upon reading the foregoing description. Accordingly, such alternatives, changes or modifications are to be considered as forming a part of the invention insofar as they fall within the spirit and scope of the appended claims.

I claim:

1. A suspender fastener comprising: a first lever; a second lever pivotally connected to said first lever in a manner so as to form a fulcrum therebetween, said first and second levers having a first pair of mutually proximate end portions longitudinally spaced from said fulcrum, at least one of said first and second levers having garment-engageable means thereon at said first pair of end portions for securing a garment thereto; said garment-engageable means comprises a plurality of teeth, each respective one of said plurality of teeth being disposed toward the other one of said first and second levers; each respective one of said plurality of teeth being further disposed toward said fulcrum; and a ratchet, said first and second levers having a second pair of mutually proximate end portions longitudinally spaced in distal relation to said first pair of end portions, at least one of said first and second levers having ratchetable means thereon at said second pair of end portions engageable by said ratchet for variably urging said second pair of end portions apart thereby variably urging said first pair of end portions together; said ratchetable means comprises a plurality of serrations, each respective one of said serrations being laterally spaced relatively farther from the other one of said first and second levers than an adjacent one of said serrations which is longitudinally spaced relatively farther from said fulcrum than said one of said serrations; and said ratchet comprises rotatable-catch means for engaging at least one of said plurality of serrations, rotation of said rotatable-catch means through a predetermined angle about an axis transversely disposed intermediate said first and second levers thereby causing said catch means to disengage from at least one of said plurality of serrations and to engage said adjacent one of said serrations for progressively urging said first pair of end portions together.

2. A suspender fastener securable to a garment comprising: a first lever; a second lever; pivot means intermediate and integral with said first and second levers for pivotally connecting said first lever to said second lever and for forming a fulcrum therebetween, said first and second levers having a first pair of mutually proximate end portions longitudinally spaced from said pivot means and a second pair of mutually proximate end portions in distal relation to said first pair of end portions, one of said first and second pairs of end portions having garment-engageable means intermediate and integral with said first and second levers for imposing pressure upon said garment engaged therebetween; and a ratchet, the other of said first and second pairs of end portions having ratchetable means intermediate and integral with said first and second levers and engageable by said ratchet for variably urging said other pair of end portions mutually apart thereby variably increasing said pressure for securing said garment to said fastener; said garment-engageable means comprises a first plurality of longitudinally arranged teeth and a second plurality of longitudinally arranged teeth, each respective one of said first plurality of teeth being integral with one of said first and second levers and being disposed toward the other other one of said first and second levers and towards said pivot means, each respective one of said second plurality of teeth being integral with said other one of said first and second levers and being disposed toward one of said first and second levers and towards said pivot means, said first plurality of teeth and said second plurality of teeth interfitting both longitudinally and transversely; said ratchetable means comprises a first plurality of longitudinally arranged serrations and a second plurality of longitudinally arranged serrations, said first plurality of serrations being integral with one of said first and second levers, said second plurality of serrations being integral with the other one of said first and second levers, each respective one of said first and second plurality of serrations being laterally spaced relatively farther from an opposed respective one of said first and second plurality of serrations than a respective adjacent one of said first and second plurality of serrations which is longitudinally spaced relatively farther from said pivot means than said respective one of said first and second plurality of serrations; and said ratchet comprises rotatable-catch means for engaging at least one of said first plurality of serrations and at least one of said second plurality of serrations, rotation of said rotatable-catch means through a predetermined angle about an axis transversely disposed intermediate said first and second levers thereby causing said catch means to disengage from at least one of said first and second plurality of serrations and to engage said respective adjacent one of said first and second plurality of serrations for progressively imposing said pressure upon said garment.

3. The suspender fastener of claim 2 wherein rotation of said rotatable-catch means through a second predetermined angle about said axis causes said catch means to disengage from said first and second plurality of serrations for longitudinally moving said catch means proximate to said pivot means for relaxing said pressure.

4. The suspender fastener of claim 2 wherein said ratchet further includes an integral loop in distal relation to said catch means for securing a suspender thereto.

* * * * *